US011614300B2

(12) United States Patent
Davis et al.

(10) Patent No.: US 11,614,300 B2
(45) Date of Patent: Mar. 28, 2023

(54) THREADED BARREL WITH HIDDEN THREADS

(71) Applicant: NIGHTHAWK CUSTOM LLC, Berryville, AR (US)

(72) Inventors: Nelson Davis, Berryville, AR (US); Daniel Thomas, Harrison, AR (US)

(73) Assignee: NIGHTHAWK CUSTOM LLC, Berryville, AR (US)

( * ) Notice: Subject to any disclaimer, the term of this patent is extended or adjusted under 35 U.S.C. 154(b) by 0 days.

(21) Appl. No.: 17/352,986

(22) Filed: Jun. 21, 2021

(65) Prior Publication Data

US 2022/0404112 A1 Dec. 22, 2022

(51) Int. Cl.
*F41A 21/32* (2006.01)

(52) U.S. Cl.
CPC ..... *F41A 21/325* (2013.01)

(58) Field of Classification Search
CPC ..... F41A 21/325
USPC ..... 42/76.1; 89/14.05
See application file for complete search history.

(56) References Cited

U.S. PATENT DOCUMENTS 3,677,132 A * 7/1972 Plenge ..... F41A 35/02 89/31
4,127,056 A * 11/1978 Kart ..... F41A 21/488 89/196
7,588,122 B2 * 9/2009 Brittingham ..... F41A 21/325 89/14.4
8,387,299 B1 * 3/2013 Brittingham ..... F41A 21/30 89/14.4
8,701,326 B2 * 4/2014 Zonshine ..... F41A 21/482 89/14.05
8,991,293 B1 * 3/2015 Karfiol ..... F41A 21/02 42/76.01
9,182,187 B1 * 11/2015 Griffith ..... F41A 21/325
2016/0102935 A1 * 4/2016 Young ..... F41A 21/325 42/76.01
2016/0138882 A1 * 5/2016 Curry ..... F41A 21/00 89/14.05
2017/0205178 A1 * 7/2017 Niswander ..... F41A 21/325
2017/0292806 A1 * 10/2017 Gangl ..... F16B 39/24
2021/0310758 A1 * 10/2021 Kellgren ..... F41A 9/45

OTHER PUBLICATIONS

Glock Talk, "O-ring to retain thread protector?," Dec. 25, 2017, internet publication found here: https://www.glocktalk.com/threads/o-ring-to-retain-thread-protector. 1686420/, pp. 1 and 5. (Year: 2017).*

* cited by examiner

*Primary Examiner* — Bret Hayes
(74) *Attorney, Agent, or Firm* — Eversheds Sutherland (US) LLP

(57) ABSTRACT

Firearms having threaded barrels with hidden threads. The barrel has a threaded portion disposed within the slide of the firearm when the firearm is in battery so that the muzzle end of the barrel is aligned with the muzzle end of the slide. The barrel is configured to couple with a barrel attachment, such as a thread protector, such that the coupling portion of the barrel attachment is disposed within the slide of the firearm when the firearm is in battery.

8 Claims, 9 Drawing Sheets

THREADED BARREL WITH HIDDEN THREADS

FIELD OF THE DISCLOSURE

This disclosure relates generally to firearms and firearm attachments and, in particular, relates to threaded firearm barrels for securing an attachment to a firearm.

BACKGROUND

Firearms, including handguns and rifles, sometimes include the ability to affix an attachment to the end of the firearm barrel. These attachments range from suppressors designed to slow down the expansion of gas as a bullet leaves a barrel, to flash hiders designed to reduce the burning of unburnt gunpowder as the bullet leaves the barrel. Since the barrel attachment must be securely fastened to the firearm barrel without affecting the passage of a bullet through the barrel, much attention has been paid in the industry to the means for affixing an attachment to the firearm barrel.

Prior means for affixing an attachment to a firearm barrel involve adding threads to the muzzle end of the barrel. In order to facilitate the addition and removal of an attachment to firearms having slides, the threads at the muzzle end of the barrel protrude beyond the slide when the firearm is at rest, that is, not in the process of firing. However, protruding threads are susceptible to damage, which damage makes them inoperable for their intended purposes of receiving an attachment.

In order to prevent damage to protruding threads, a thread protector configured to couple to the protruding threads is added. A thread protector serves no purpose beyond protecting the protruding threads. However, thread protectors themselves protrude beyond the slide when the firearm is at rest. As a result, a barrel designed to have an attachment is inescapably longer from breech to muzzle than an equivalent firearm without threads or other means for securing an attaching at the muzzle end of the barrel. Therefore, firearms with protruding threads require a holster designed to account for the protruding threads and thread protector.

Finally, firearms having protruding threads, with or without a thread protector, have a different visual appearance due to the presence of the protruding threads, which influences the purchasing decisions of some firearm users. As a result, a user may purchase a firearm that does not have the ability to affix an attachment solely because of the protruding threads.

Accordingly, improved barrels having threads that do not protrude beyond the slide of a firearm are needed.

BRIEF DESCRIPTION OF THE DRAWINGS

The detailed description is set forth with reference to the accompanying drawings. The use of the same reference numerals may indicate similar to identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
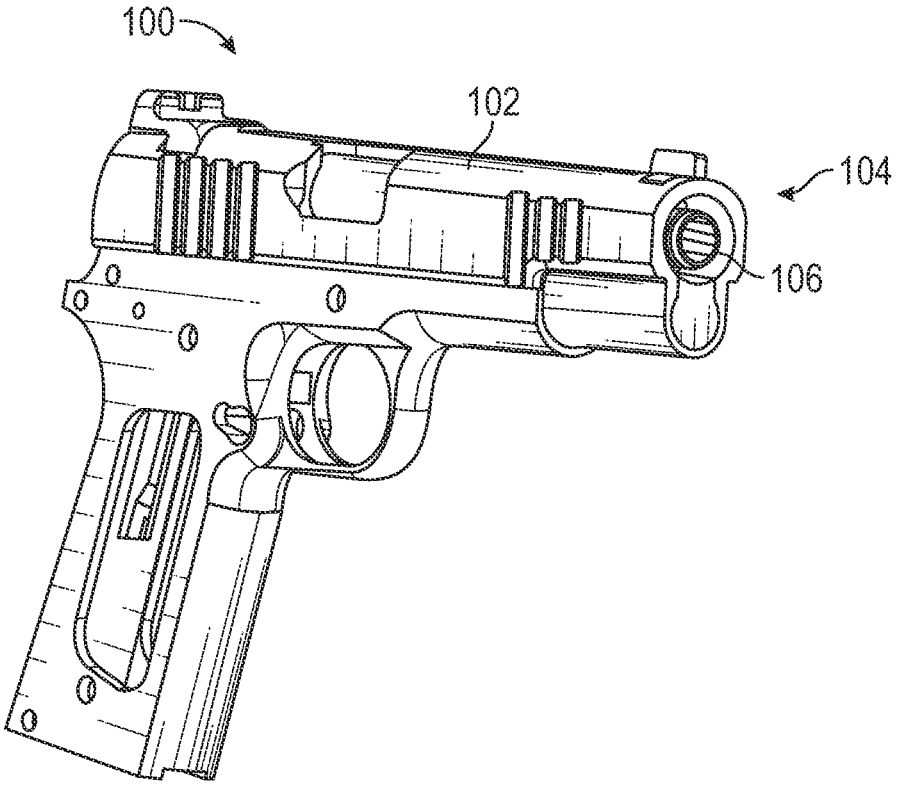
FIG. 1 is a front-side view of a firearm in accordance with the present disclosure.

Firearms are provided herein including barrels that advantageously reduce or eliminate the protrusion of threads beyond the slide of the firearm. The embodiments are described in detail herein to enable one of ordinary skill in the art to practice the threaded barrel with hidden threads, although it is to be understood that other embodiments may be made without departing from the scope of the disclosure.

Throughout this disclosure, various aspects are presented in a range format. It should be understood that the description in range format is merely for convenience and brevity and should not be construed as an inflexible limitation on the scope of the disclosure. Accordingly, the description of a range should be considered to have specifically disclosed all the possible sub-ranges as well as individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6, etc., as well as individual numbers within that range, for example, 1, 2, 3, 4, 5, and 6. This applies regardless of the breadth of the range.

Any known method of making or manufacturing firearm barrels can be used to make the threaded barrels with hidden threads described herein. For example, the firearm barrels may be machined from a metal blank, they may be cast using a mold, or another suitable method.

Any known material suitable for firearm barrels may be used to make the threaded barrels described herein. For example, the firearm barrels may be made out of aluminum, steel, another metal, or an alloy thereof. Any suitable material may be used.

Threaded barrels with hidden threads have been produced that have a threaded portion at a muzzle end of the barrel disposed within the slide of a firearm. The threaded portion is configured to couple to the coupling portion of a barrel attachment such as a thread protector.

Threaded Barrel with Hidden Threads

Firearms are disclosed herein. In some embodiments, the firearm includes a slide having a muzzle end. The firearm may include a barrel disposed within the slide having a longitudinal axis. In some embodiments, the barrel includes a breech portion and a threaded portion at the muzzle end of the barrel. The threaded portion of the barrel may have threads facing radially outwards that are disposed within the slide when the firearm is in battery.

As used herein, the "muzzle end" refers to the end of a firearm located at or proximal to the muzzle, where a fired bullet exits the firearm.

As used herein, "in battery" refers to the state of the firearm when it is at rest, before firing, or after firing. In other words, "in battery" refers to any state of the firearm except during the firing action, in which the slide of the firearm actuates.

The use of relational terms, such as, but not limited to, "top," "bottom," "left," "right," "front," "back," "upward," "downward," "beneath," "underside," "fore," "aft," and the like are used in the written description for clarity in specific reference to the Figures, or to refer the relative disposition of portions of the firearm and/or barrel, and are not intended to further limit the scope of the invention or the appending claimed. For example, a portion may be "beneath" another portion, but such a portion does not necessarily have to be on the "bottom" as viewed by an observer. Any relative positioning in three-dimensional space of the portions and components of the firearm and/or barrel is contemplated.

In some embodiments, the firearm includes a barrel attachment having a coupling portion. The coupling portion of the barrel attachment may include second threads facing radially inwards that are configured to engage with the threads on the threaded portion of the barrel so that the barrel attachment is at least partially disposed within the slide when the firearm is in battery.

In some embodiments, the muzzle end of the barrel is aligned with the muzzle end of the slide when the firearm is in battery. In other words, the surface of the muzzle end of the barrel that is perpendicular to the longitudinal axis of the barrel is co-planar, or substantially co-planar, to the surface of the muzzle end of the slide that is perpendicular to the longitudinal axis of the barrel when the firearm is in battery.

In some embodiments, the muzzle end of the barrel and the muzzle end of the slide are considered "flush." As used herein, "flush" means that neither the muzzle end of the barrel nor the muzzle end of the slide extends appreciably beyond the other in a direction parallel to the longitudinal axis of the barrel when the firearm is in battery.

In some embodiments, the barrel attachment is a suppressor. In other embodiments, the barrel attachment is a flash hider. The barrel attachment may alternatively be a compensator, or a mount adapter for interfacing the barrel to an attachment, perhaps when the thread pitch of the attachment and barrel do not match or use alternate coupling techniques altogether. In some embodiments, the coupling portion of the barrel attachment includes a piston which may at least partially be disposed within the slide when the firearm is in battery. Any suitable barrel attachment having a suitable coupling portion may be used in the firearm of the present invention.

In some embodiments, the barrel attachment is a barrel thread protector. The barrel thread protector may have a muzzle end such that, when the thread protector is coupled to the barrel, the muzzle end of the thread protector is aligned with the muzzle end of the slide and the muzzle end of the barrel when the firearm is in battery. In other words, the surface of the muzzle end of the barrel that is perpendicular to the longitudinal axis of the barrel is parallel to the surface of the muzzle end of the thread protector, and is co-planar to the surface of the muzzle end of the slide, that are perpendicular to the longitudinal axis of the barrel when the firearm is in battery. The muzzle end of the barrel, the muzzle end of the thread protector, and the muzzle end of the slide are considered "flush" with one another when the firearm is in battery.

In some embodiments, the breech portion of the barrel has an outer diameter, and the thread protector has a diameter less than or equal to the outer diameter of the breech portion of the barrel. In other words, the thread protector has an outer diameter that is less than the diameter of the aperture of the slide at the muzzle end through which the barrel extends during firing. Thus, when the slide actuates during a firing action, the slide does not contact the thread protector.

In some embodiments, the thread protector includes an O-ring disposed within the thread protector. In some embodiments, the breech portion of the barrel has an outer diameter, the threaded portion of the barrel has a diameter smaller than the outer diameter of the breech portion, and a boundary separates the breech portion and the threaded portion. In other words, the point at which the diameter of the barrel increases from the diameter of the threaded portion to the diameter of the breech portion is the boundary, also referred to as a shoulder. In some embodiments, the boundary includes an attachment stop surface perpendicular to the longitudinal axis of the barrel.

In some embodiments, the threaded portion of the barrel includes an engagement surface disposed on the threaded portion fore of the threads on an outer surface of the barrel. The O-ring in the thread protector may be configured to contact the engagement surface of the barrel. In some embodiments, when the O-ring contacts the engagement surface of the barrel, the thread protector is configured to have a gap between an aft end of the thread protector and the attachment stop surface of the barrel.

In some embodiments, the O-ring is operable to prevent rotation of the thread protector when the slide actuates during use of the firearm. In some embodiments, the thread protector includes knurling and is configured to be removed by a user without the use of tools.

In some embodiments, the barrel attachment is a mount adapter configured to couple to the threads of the threaded portion of the barrel. The mount adapter may include a secondary coupling portion configured for coupling to a barrel attachment outside the slide.

FIG. 1 is a front perspective view of a firearm 100 having a slide 102, a muzzle end 104, and a barrel 106. Firearm 100 is depicted in battery. Muzzle end of barrel 106 is aligned with the muzzle end of the slide 102.

Figure 2A:
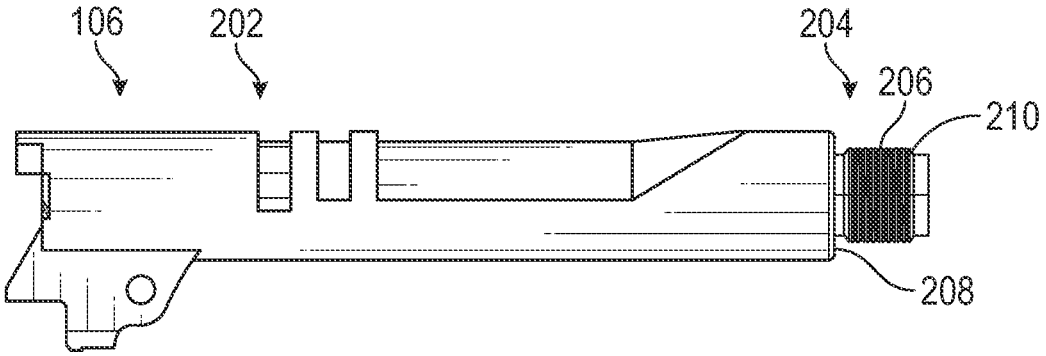
FIG. 2A is a side view of a firearm barrel in accordance with the present disclosure.
Figure 2B:
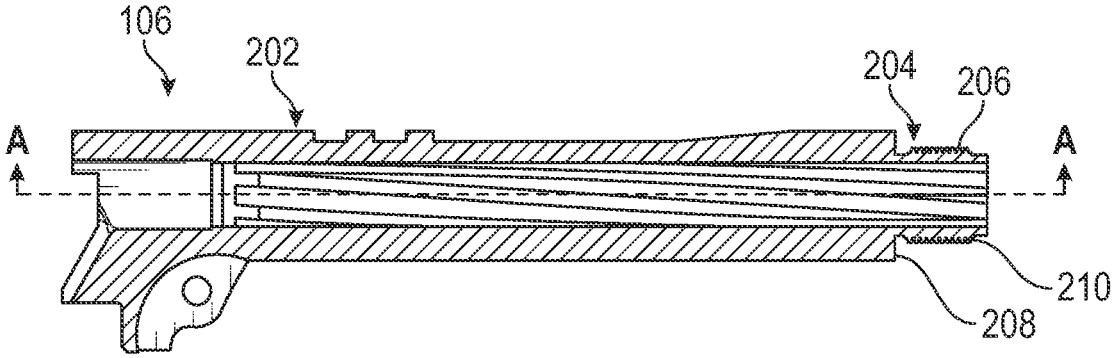
FIG. 2B is a cross-sectional view of the firearm barrel in FIG. 2A in accordance with the present disclosure.

FIG. 2A is a side view of barrel 106 having a breech portion 202 and a threaded portion 204. Threaded portion 204 includes threads 206. Breech portion 202 and threaded portion 204 are separated by a boundary including an attachment stop surface 208. Threaded portion further includes an engagement surface 210 located fore of the threads 206. FIG. 2B is a cross-sectional view of barrel 106, which has a longitudinal axis A.

Figure 3:
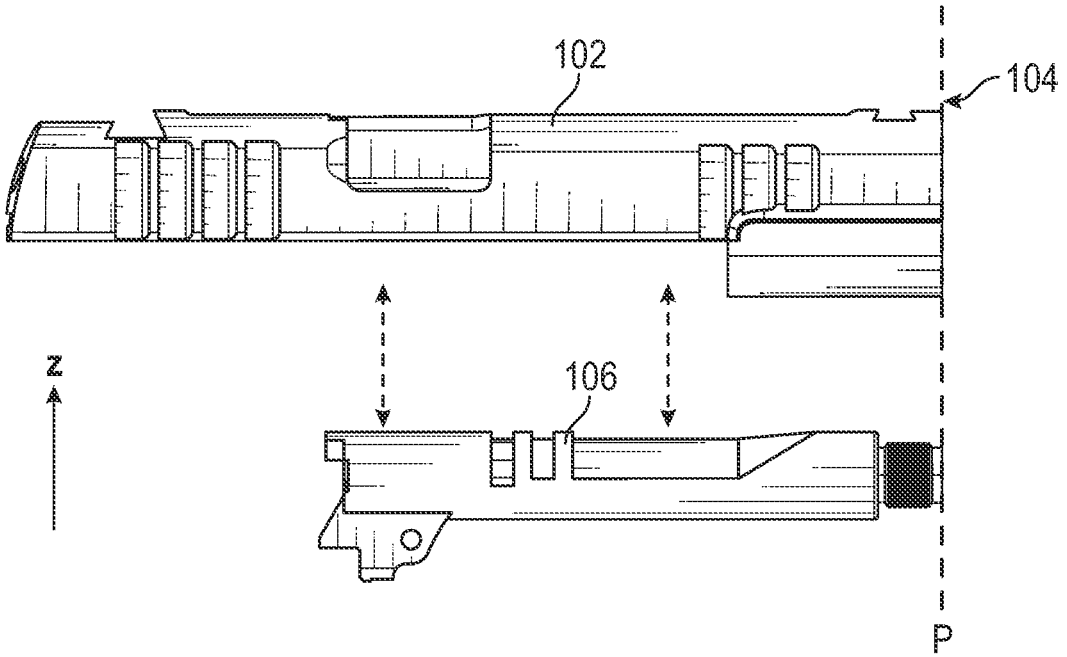
FIG. 3 is a side view of a firearm barrel and firearm slide in accordance with the present disclosure.

FIG. 3 is an exploded side view of slide 102 and barrel 106. The slide 102 has been transposed in the Z-direction, illustrating the alignment of the muzzle end 104 of slide 102 and the muzzle end of barrel 106.

Figure 4:
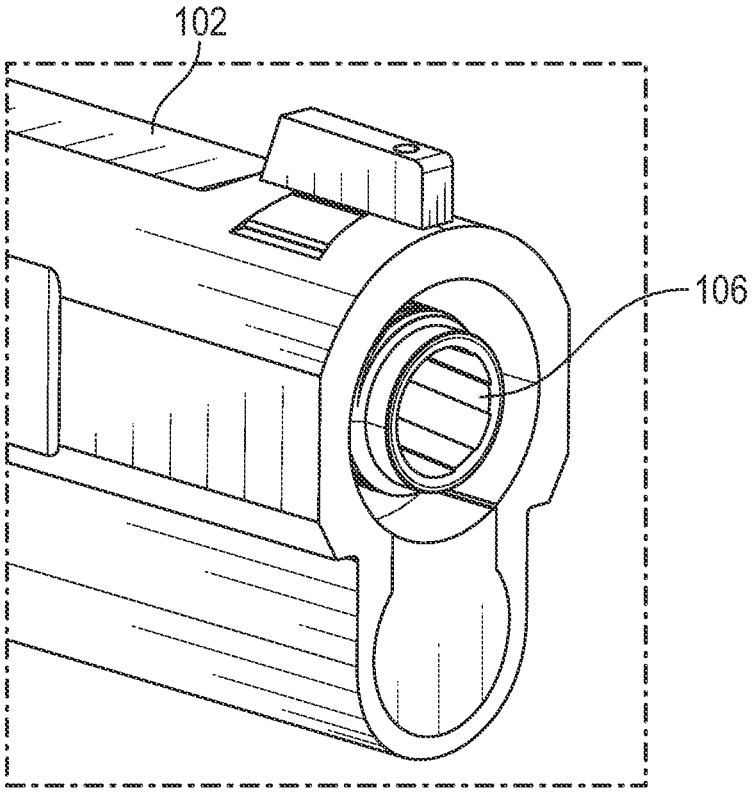
FIG. 4 is a front side view of the muzzle end of a firearm in accordance with the present disclosure.

FIG. 4 is a front perspective view of the muzzle end 104 of firearm 100 illustrating the relative positioning of slide 102 and barrel 106 in a rest position. Muzzle end 104 of slide 102 is aligned with the muzzle end of barrel 106.

Figure 5:
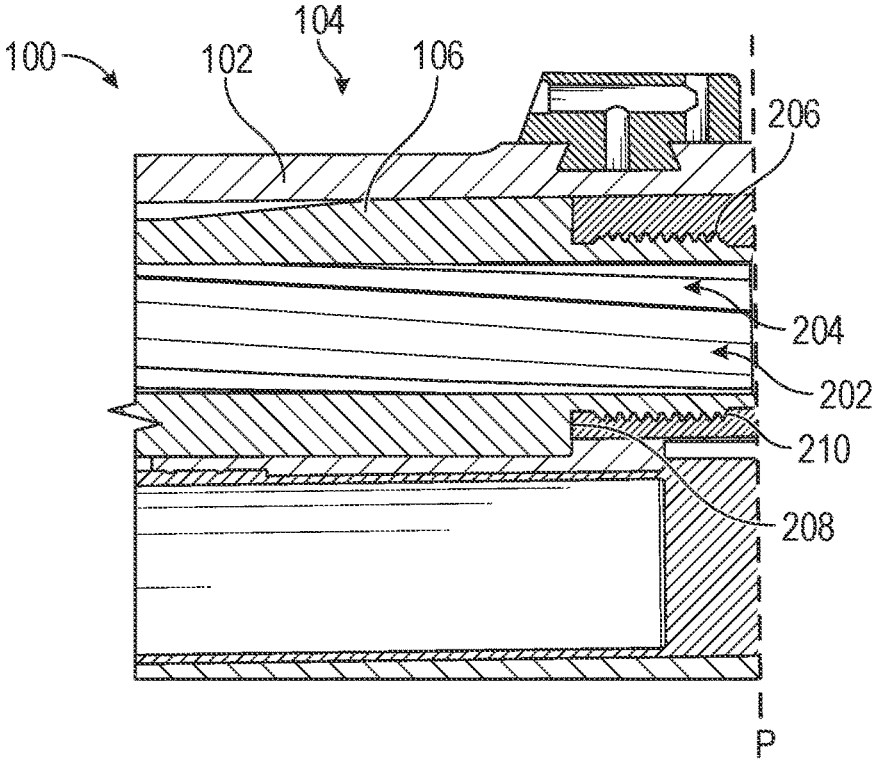
FIG. 5 is a side view in cross section of the muzzle end of a firearm in accordance with the present disclosure.

FIG. 5 is a side view in cross section of the muzzle end 104 of a firearm 100 including slide 102 and barrel 106. Barrel 106 includes a breech portion 202 and a threaded portion 204. Muzzle end of slide 102 and muzzle end of barrel 106 are co-planar with each other at plane P, which is perpendicular to the longitudinal axis of the barrel 106 when the firearm 100 is in battery. Threaded portion 204 includes threads 206, a boundary that includes an attachment stop surface 208, and an engagement surface 210.

Figure 6:
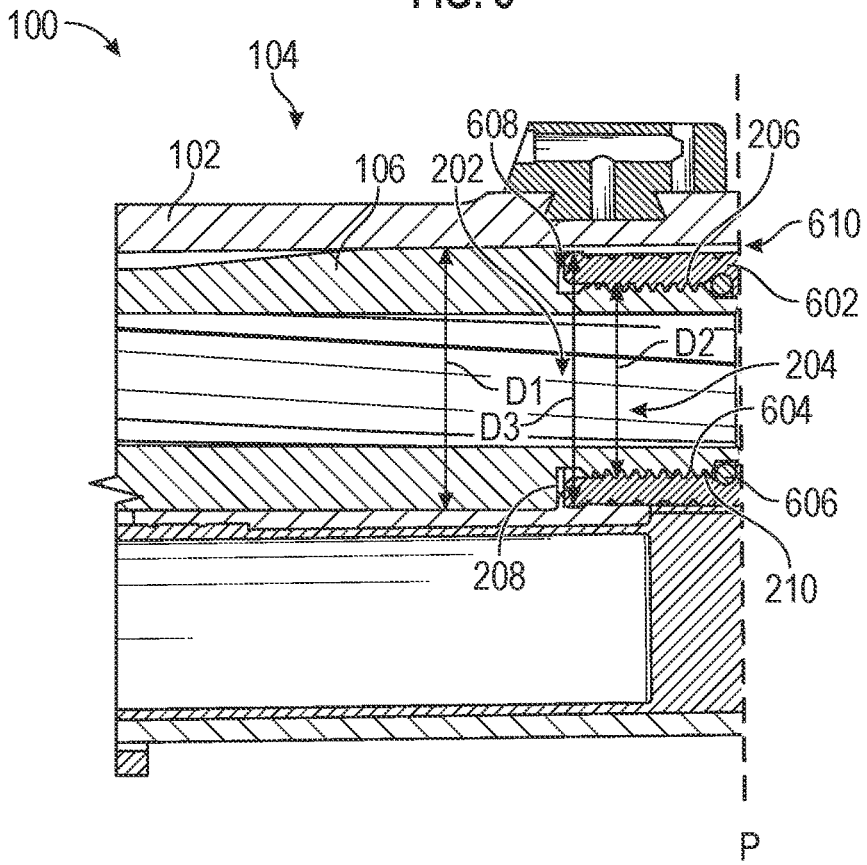
FIG. 6 is a side view in cross section of the muzzle end of a firearm having a thread protector in accordance with the present disclosure.

FIG. 6 is a side view in cross section of the muzzle end 104 of a firearm 100 including a thread protector 602. Thread protector 602 includes threads 604 that are configured to engage with threads 206 on the threaded portion 204 of barrel 106. Thread protector 602 further includes an O-ring 606 configured to contact engagement surface 210 of the threaded portion 204 of barrel 106 such that a gap 608 exists between the thread protector 602 and the attachment stop surface 208. Breech portion 202 of barrel 106 has an outer diameter D1. Threaded portion 204 of barrel 106 has an outer diameter D2 that is less than D1. Thread protector 602 has an outer diameter D3 that is less than or equal to D1. Thread protector 602 outer diameter D3 is sized to fit within the inner diameter of slide 102 such that gap 610 is minimized without resulting in slide 102 contacting thread protector 602 when the slide actuates. Muzzle end of slide 102 and muzzle end of thread protector 602 may be co-planar with each other at plane P, which is perpendicular to the longitudinal axis of the barrel 106 when the firearm 100 is in battery. In some embodiments, the muzzle end of barrel 106 is also co-planar with plane P.

Figure 7:
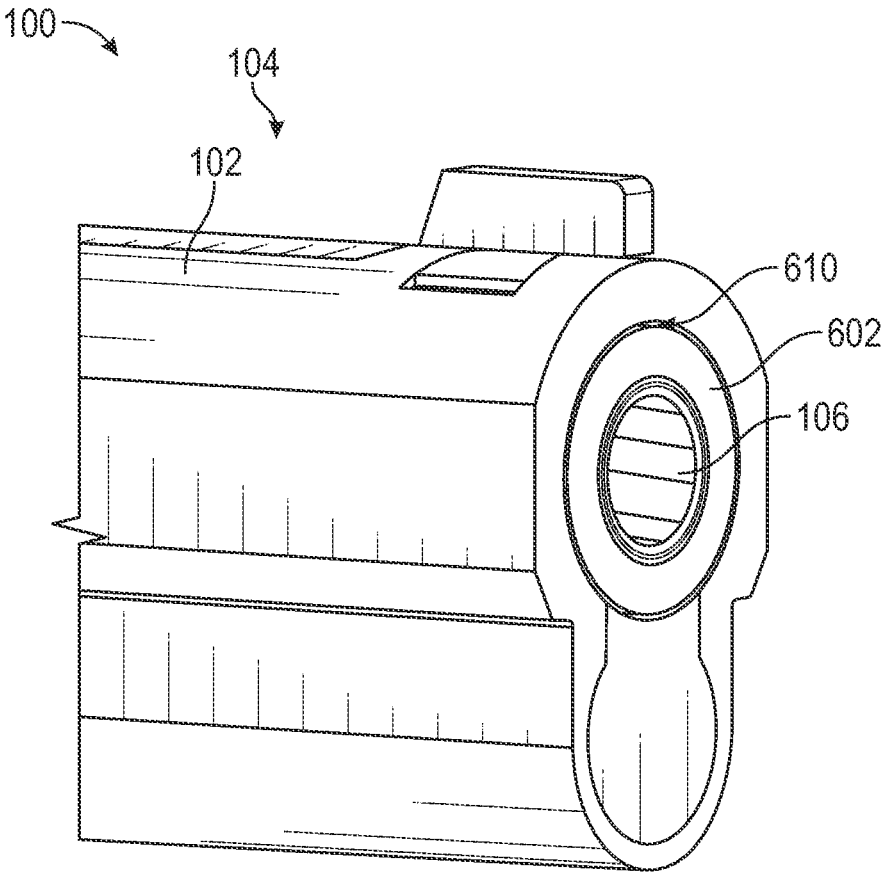
FIG. 7 is a front side view of the muzzle end of a firearm having a thread protector in accordance with the present disclosure.

FIG. 7 is a front perspective view of the muzzle end 104 of a firearm 100 having slide 102, barrel 106, and thread protector 602. Muzzle end of thread protector 602 is co-planar with the muzzle end of the slide 102 and the muzzle end of barrel 106 when the firearm 100 is in battery, also illustrated in FIG. 6.

Figure 8B:
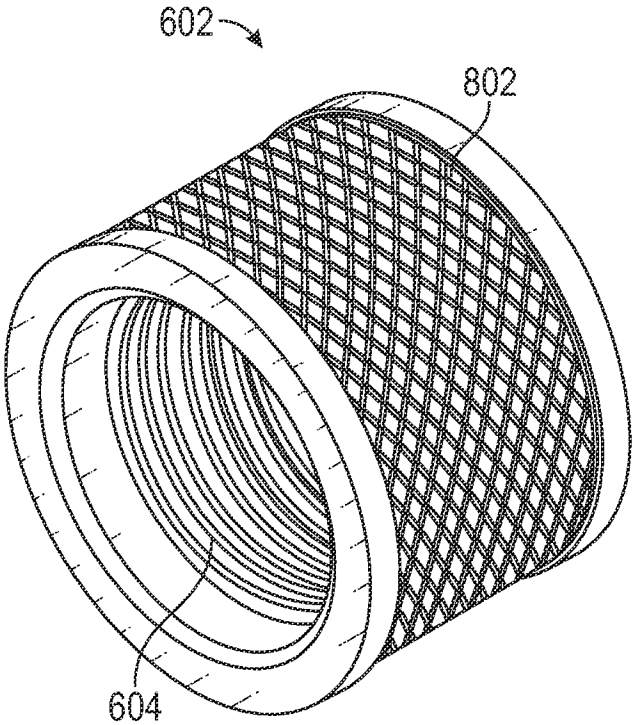
FIG. 8B is a perspective view of the thread protector in FIG. 8A in accordance with the present disclosure.
Figure 8A:
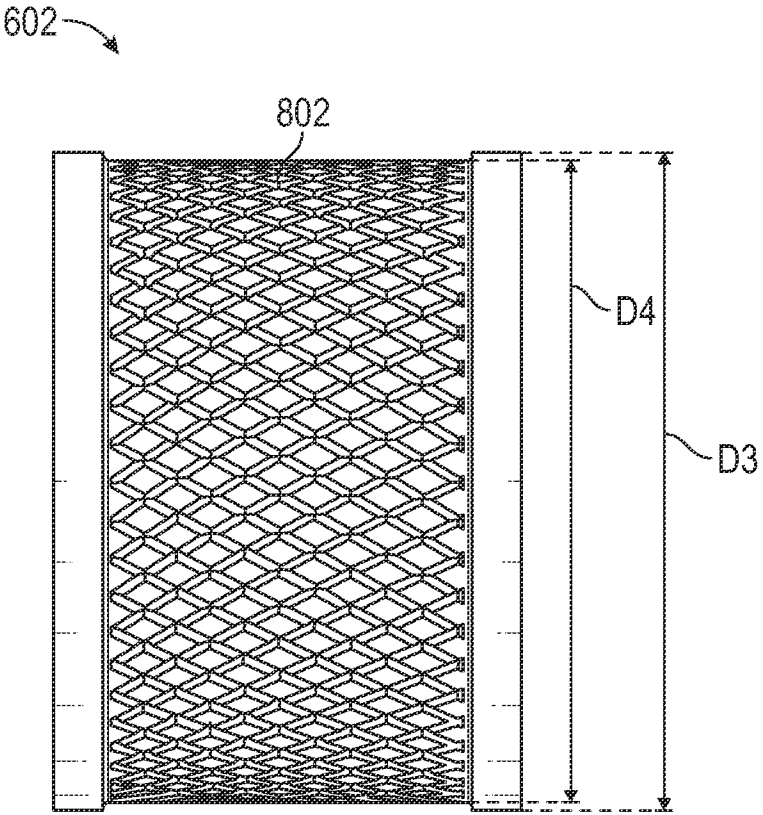
FIG. 8A is a side view of a thread protector in accordance with the present disclosure.

FIG. 8A is a perspective view of thread protector 602. Thread protector 602 has knurling portion 802 configured to aid a user in adding or removing thread protector 602 from a firearm. Outer diameter D3 of thread protector 602 is greater than diameter D4, corresponding to the outermost diameter of the knurling portion. FIG. 8B is a perspective view of thread protector 602 having knurling portion 802 and threads 604.

Figure 9B:
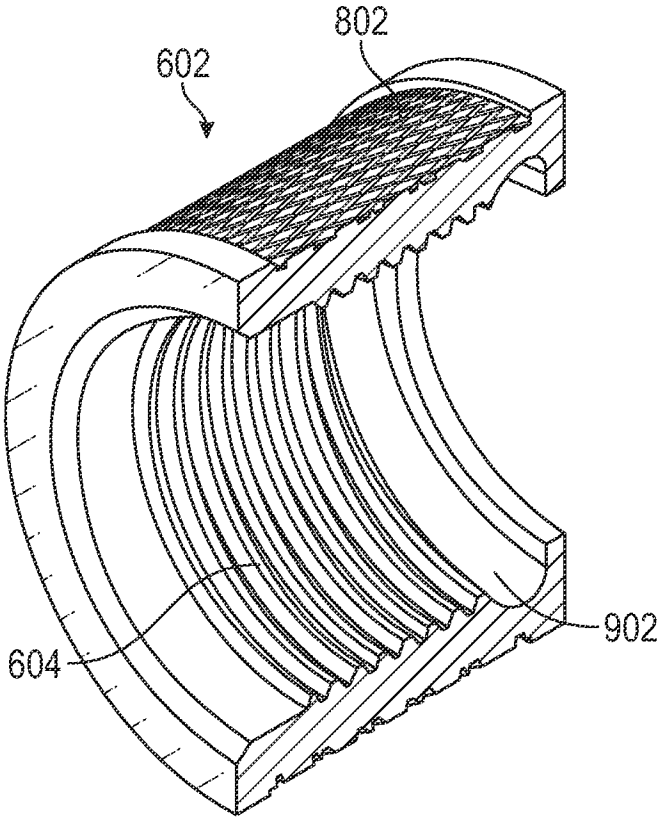
FIG. 9B is a perspective view in cross section of the thread protector of FIG. 9A in accordance with the present disclosure.
Figure 9A:
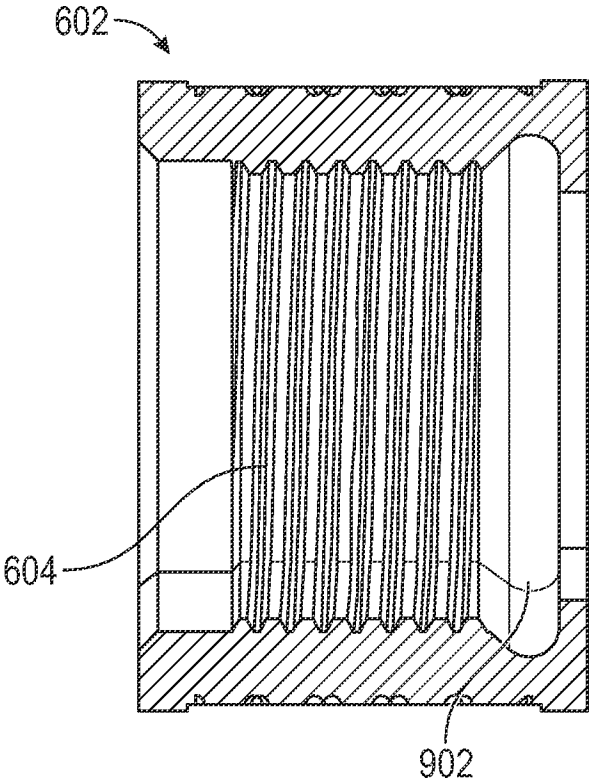
FIG. 9A is a side view in cross section of a thread protector in accordance with the present disclosure.

FIG. 9A is a side view in cross section of thread protector 602 having threads 604 and O-ring channel 902. O-ring channel 902 is configured to secure an O-ring. FIG. 9B is a perspective view in cross section of thread protector 602 having threads 604, knurling 802, and O-ring channel 902.

Figure 10:
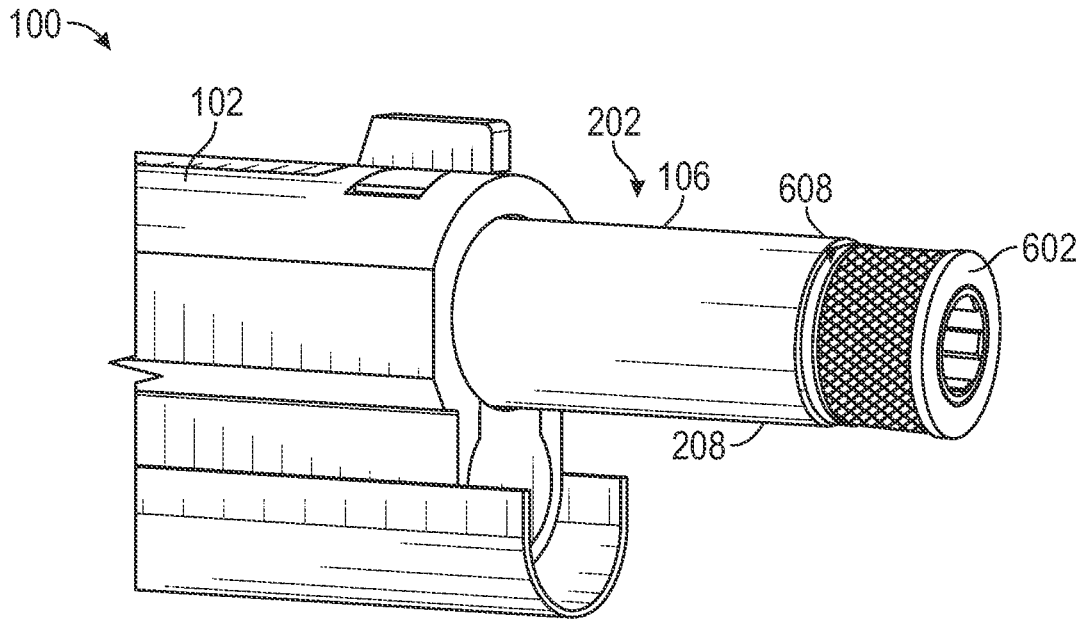
FIG. 10 is a perspective view of a firearm having a thread protector in accordance with the present disclosure.

FIG. 10 is a perspective view of firearm 100 having slide 102, barrel 106, and thread protector 602. Slide 102 is illustrated in an actuated position, resembling the slide's position during a firing action or when manually actuated by a user. O-ring (not pictured) is configured to prevent thread protector 602 from auto-tightening during the firing action, so gap 608 exists between thread protector 602 and attachment stop surface 208.

Figure 11:
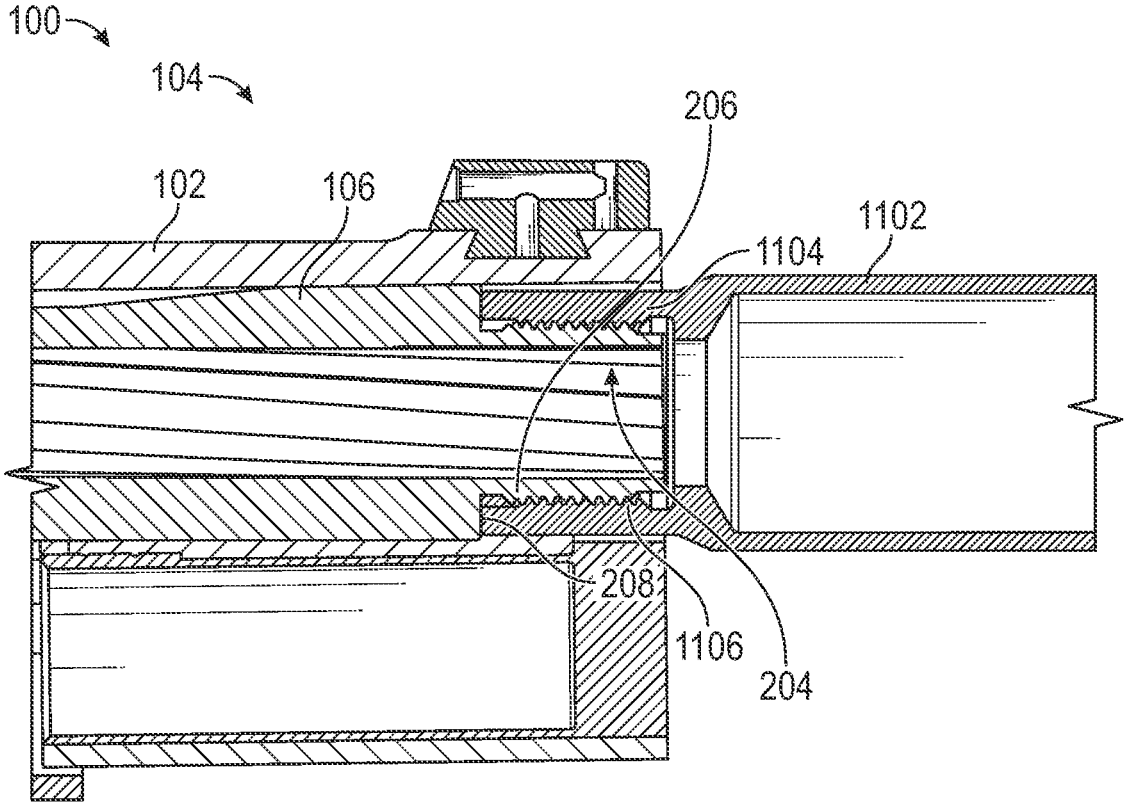
FIG. 11 is a side view in cross section of a firearm having a barrel attachment in accordance with the present disclosure.

FIG. 11 is a side view in cross section of the muzzle end 104 of firearm 100 including a barrel attachment 1102. Barrel attachment 1102 has an elongated coupling portion 1104 that includes threads 1106 that are configured to couple to threads 206 on the threaded portion 204 of barrel 106. Coupling portion 1104 has an outer diameter configured to be disposed within slide 102 when coupling portion 1104 is coupled to barrel 106 and when the firearm 100 is in battery. In some embodiments, coupling portion 1104 is configured to contact attachment stop surface 208. In some embodiments, an O-ring may be disposed within the coupling portion 1104 as described previously.

Figure 12:
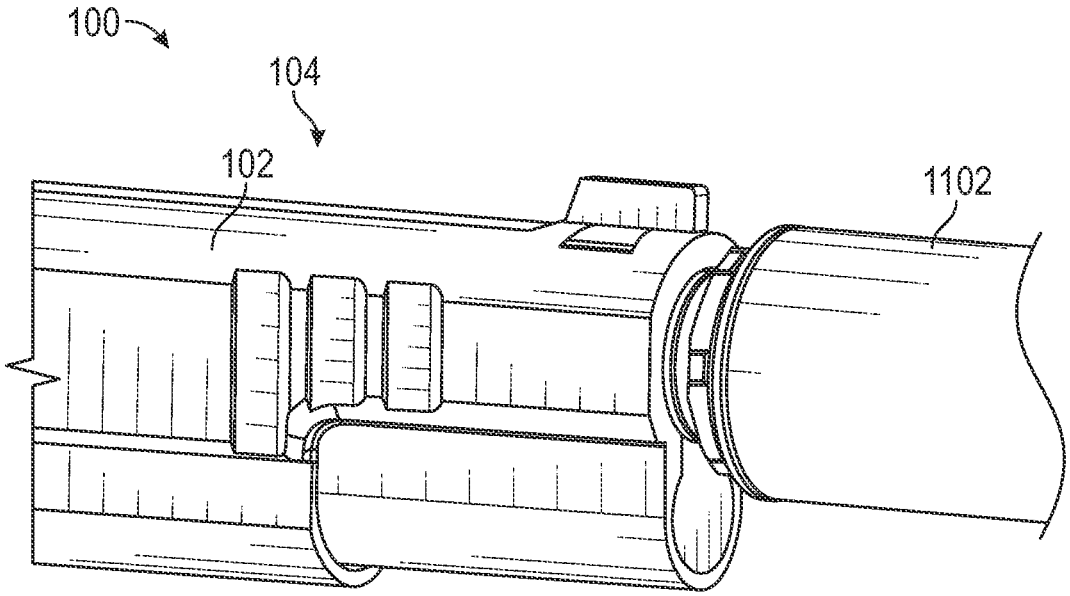
FIG. 12 is a perspective view of a firearm having a barrel attachment in accordance with the present disclosure.

FIG. 12 is a front side view of the muzzle end 104 of firearm 100 including slide 102 and barrel attachment 1102.

Figure 13:
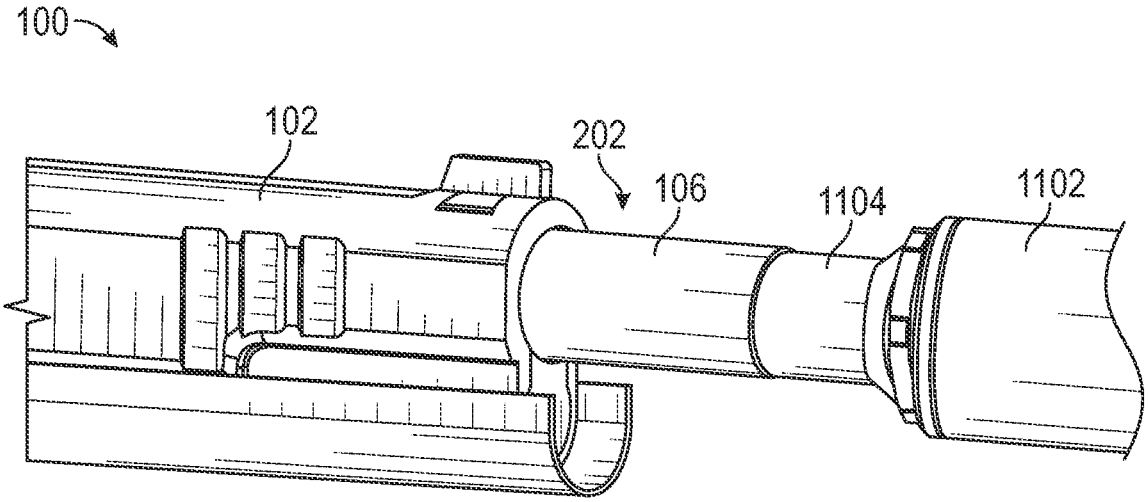
FIG. 13 is a perspective view of a firearm having a barrel attachment in accordance with the present disclosure.

FIG. 13 is a front side view of the muzzle end 104 of firearm 100 having a slide 102, barrel 106, and barrel attachment 1102 having a coupling portion 1104. Slide 102 is illustrated in an actuated position, resembling the slide's position during a firing action or when manually actuated by a user.

While the disclosure has been described with reference to a number of embodiments, it will be understood by those skilled in the art that the disclosure is not limited to such embodiments. Rather, the disclosure can be modified to incorporate any number of variations, alterations, substitutions, or equivalent arrangements not described herein, but which are commensurate with the spirt and scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements or functional capabilities. Additionally, while various embodiments of the disclosure have been described, it is to be understood that aspects of the disclosure may include only some of the described embodiments. Accordingly, the disclosure it not to be seen as limited by the foregoing described, but is only limited by the scope of the appended claims.

The invention claimed is:

1. A firearm comprising:

a slide comprising a muzzle end;

a barrel disposed within the slide, wherein the barrel comprises a longitudinal axis and a threaded portion at a muzzle end of the barrel; and a barrel thread protector comprising:

a coupling portion; and a muzzle end, wherein when the thread protector is coupled to the barrel, the muzzle end of the thread protector is aligned flush with the muzzle end of the slide and the muzzle end of the barrel when the firearm is in battery;

wherein the threaded portion of the barrel comprises first threads facing radially outwards, wherein the threads are disposed within the slide when the firearm is in battery; and wherein the coupling portion of the barrel thread protector comprises second threads facing radially inwards that engage with the first threads on the threaded portion of the barrel so that the barrel thread protector is disposed within the slide when the firearm is in battery.

2. The firearm of claim 1, wherein the muzzle end of the barrel is aligned with the muzzle end of the slide when the firearm is in battery.

3. The firearm of claim 1, wherein the breech portion of the barrel has an outer diameter, and wherein the thread protector has a diameter less than or equal to the outer diameter of the breech portion of the barrel.

4. The firearm system of claim 1, wherein the thread protector comprises an O-ring disposed within the thread protector.

5. The firearm system of claim 4, wherein the O-ring is operable to prevent rotation of the thread protector when the slide actuates during use of the firearm.

6. The firearm system of claim 4, wherein:

the breech portion of the barrel has an outer diameter, the threaded portion of the barrel has a diameter smaller than the outer diameter of the breech portion, and the barrel comprises a boundary between the breech portion and the threaded portion, the boundary comprises an attachment stop surface perpendicular to the longitudinal axis of the barrel, and the O-ring is configured to contact an engagement surface disposed on the threaded portion fore of the threads on an outer surface of the barrel.

7. The firearm system of claim 6, wherein when the O-ring contacts the engagement surface of the barrel, the thread protector is configured to have a gap between an aft end of the thread protector and the attachment stop surface on the barrel.

8. The firearm system of claim 1, wherein the thread protector comprises knurling and is configured to be removed by a user without the use of tools.

* * * * *